United States Patent [19]

Ostermann

[11] Patent Number: 4,623,959

[45] Date of Patent: Nov. 18, 1986

[54] APPARATUS, PARTICULARLY FOR TRANSLOADING VEHICLES FOR PROVIDING A FIELD OF VIEW FOR CARRYING OUT WORK DURING DARKNESS, PARTICULARLY AT MILITARY FIELD TRANSLOADING POSTS

[75] Inventor: Georg C. Ostermann, Hamburg, Fed. Rep. of Germany

[73] Assignee: Ostermann Apparatebau Kiel GmbH, Fed. Rep. of Germany

[21] Appl. No.: 807,423

[22] Filed: Dec. 10, 1985

[30] Foreign Application Priority Data

Oct. 18, 1985 [DE] Fed. Rep. of Germany ..... 3537114

[51] Int. Cl.[4] ..... F21S 1/00

[52] U.S. Cl. ..... 362/293; 362/300; 362/301; 362/307; 350/622

[58] Field of Search ..... 362/293, 298, 299, 300, 362/301, 257, 268, 278, 324, 346, 307, 328; 350/616, 617, 612, 622, 623

[56] References Cited

U.S. PATENT DOCUMENTS 4,241,390 12/1980 Markle et al. ..... 362/299
4,497,013 1/1985 Ohta ..... 362/346

FOREIGN PATENT DOCUMENTS 124110 2/1949 Sweden ..... 362/268

*Primary Examiner*—William A. Cuchlinski, Jr.
*Assistant Examiner*—Diana M. Cox
*Attorney, Agent, or Firm*—Beveridge, De Grandi & Weilacher

[57] ABSTRACT

For carrying out work during darkness by means of transloading vehicles on military field transloading posts, the apparatus for apron illumination while not making the post visible to undesired observers, comprises an apparatus casing with a light source arranged in its interior having an upstream-connected condenser lens and with a front lens, to which are connected two plane mirrors deflecting the optical path twice by 90° with interposed inwardly and outwardly pivotable diaphragms and/or filters, an exit optics being arranged in the light beam passing out of the lower plane mirror.

4 Claims, 3 Drawing Figures

APPARATUS, PARTICULARLY FOR TRANSLOADING VEHICLES FOR PROVIDING A FIELD OF VIEW FOR CARRYING OUT WORK DURING DARKNESS, PARTICULARLY AT MILITARY FIELD TRANSLOADING POSTS

BACKGROUND OF THE INVENTION

The invention relates to an apparatus, particularly for transloading or handling vehicles, such as fork lift trucks and the like, for providing a field of view for carrying out work during darkness, particularly at military field transloading posts.

When transloading vehicles are used at night for military and semimilitary purposes, it is required that transloading and handling can be continued during darkness, without the necessary partial or complete illumination of the post giving an observer an opportunity to observe the post and the details linked with it.

The problem of being able to operate in darkness on so-called field transloading posts in an optimum invisible manner for a potential enemy has been solved in that either during complete darkness, or in the case of partial or general illumination, light energy with special spectral characteristics was used. To make this illuminating energy which is invisible to the naked eye visible for the eye, it is known to use image conversion equipment. However, it is a hindrance to wear such equipment when working and mobility, particularly with the hands free is impeded. Moreover, in the case of acceptable expenditure, such equipment is a compromise with respect to its dimensioning and optical aspects and this is not generally completely satisfactory. This particularly applies with regard to the depth of field when working within easy reach and the simultaneous orientation over a greater distance. In this respect the human eye is still the optimum image converter and after corresponding adaptation only requires a comparatively limited light energy.

SUMMARY OF THE INVENTION

The problem of the present invention is to provide an apparatus of the aforementioned type providing economic and more comfortable working conditions for personnel than was the case with the hitherto known procedures. It provides a selectively variable prefield or apron illumination adapting to the particular desired field of view, without the undesired observer being able to observe the transloading post and details thereof as a result of the apron illumination.

In the case of an apparatus of the aforementioned type this problem is solved in that the apparatus comprises an apparatus casing with a front plate, in whose interior in the upper region of the rear surface of the front plate is provided a lamp housing with a light source, a condenser lens connected upstream thereof and detecting the complete irradiated light flux and a front lens located in the optical path of the light source and to which is connected two plane mirrors which deflect the optical path twice by 90° and which are spaced from and superimposed with respect to one another, whereby between the two plane mirrors in the optical path are arranged diaphragms and/or filters which can be pivoted into and out of the same by means of electromotive or electromagnet drive means or the like and below the lamp housing is provided further case receiving exit optics for imaging the lamp coil filament in the entrance pupil of the exit optics through the front lens and wherein in the optical path of the exit optics in the front plate is provided a light exit port covered by means of a glass disk.

Advantageous developments of the invention are characterized in the subclaims.

An apparatus constructed in this way provides the possibility of continuing handling and transloading operations during darkness, e.g. on field transloading posts without the illumination thereof enabling an observer to observe the post and details associated with it. The design and construction of the apparatus makes it possible to operate in an almost invisible manner for an enemy on field transloading posts, without the enemy having the opportunity to observe the work being carried out on such posts. The apparatus can be fitted to a fork lift truck or any comparable transloading vehicle and enables the vehicle operator to observe an adequate apron or prefield and this can also be illuminated in different depths by a corresponding apparatus setting. However, the use of the apparatus is not limited to working on field transloading posts and it in fact can be used everywhere where work is carried out during the hours of darkness, requiring apron illumination and which despite this illumination is not to be observed by undesired third parties. Thus, it is e.g. possible to use the apparatus on the flightdeck of aircraft carriers or other military watercraft where apron illumination is required during darkness for stacking, the transportation of weapons and the like, without it being possible for the enemy to observe said apron as a result of the apron illumination.

It is also to be assumed that e.g. on a field transloading post the greatest risk of observation and attack comes through the enemy being able to approach through the air. It can also be assumed that the enemy will give rise to noise when approaching and consequently betrays his presence as from a definable distance. If it is now ensured that the field transloading post or the activities thereon cannot be perceived by the observer outside this definable distance, the possibility also exists to take corresponding measures on dropping below this distance, because the enemy betrays himself. Thus, the use of the apparatus provides an economic working possibility which is more comfortable for personnel than was the case with the hitherto known procedure. The aforementioned safety distance is always a multiple larger than the distance in which e.g. a fork lift truck driver must be able to recognize the goods to be transported. However, around this comparatively large distance there is a correspondingly large or larger air absorption, particularly if it is advanced by the chosen light spectrum of this absorption. On the basis of the selected spectral range of the irradiated illumination energy, the energy level must be so low tnat there is always a significant difference between the reflection energy arriving at the operator and that which reaches the undesired observer. However, detectability over longer distances results not only from the light reflected back to the observer by objects and the surroundings, but also by the radiant energy directly passing out of the optical light in the direction of the undesired observer. To limit this risk to a minimum, the irradiated light bundle of the apparatus is sharply defined, so that it fulfils all requirements existing when used on transloading vehicles at night so as to enable transloading to be maintained during the hours of darkness, without the post or apron illumination enabling an observer to observe the transloading post and details associated therewith.

BRIEF DESCRIPTION OF THE DRAWINGS

The invention is desoribed in greater detail hereinafter relative to non-limitative embodiments and the attached drawings, wherein show.

DETAILED DESCRIPTION OF THE PREFERRED EMBODIMENTS

Figure 1:
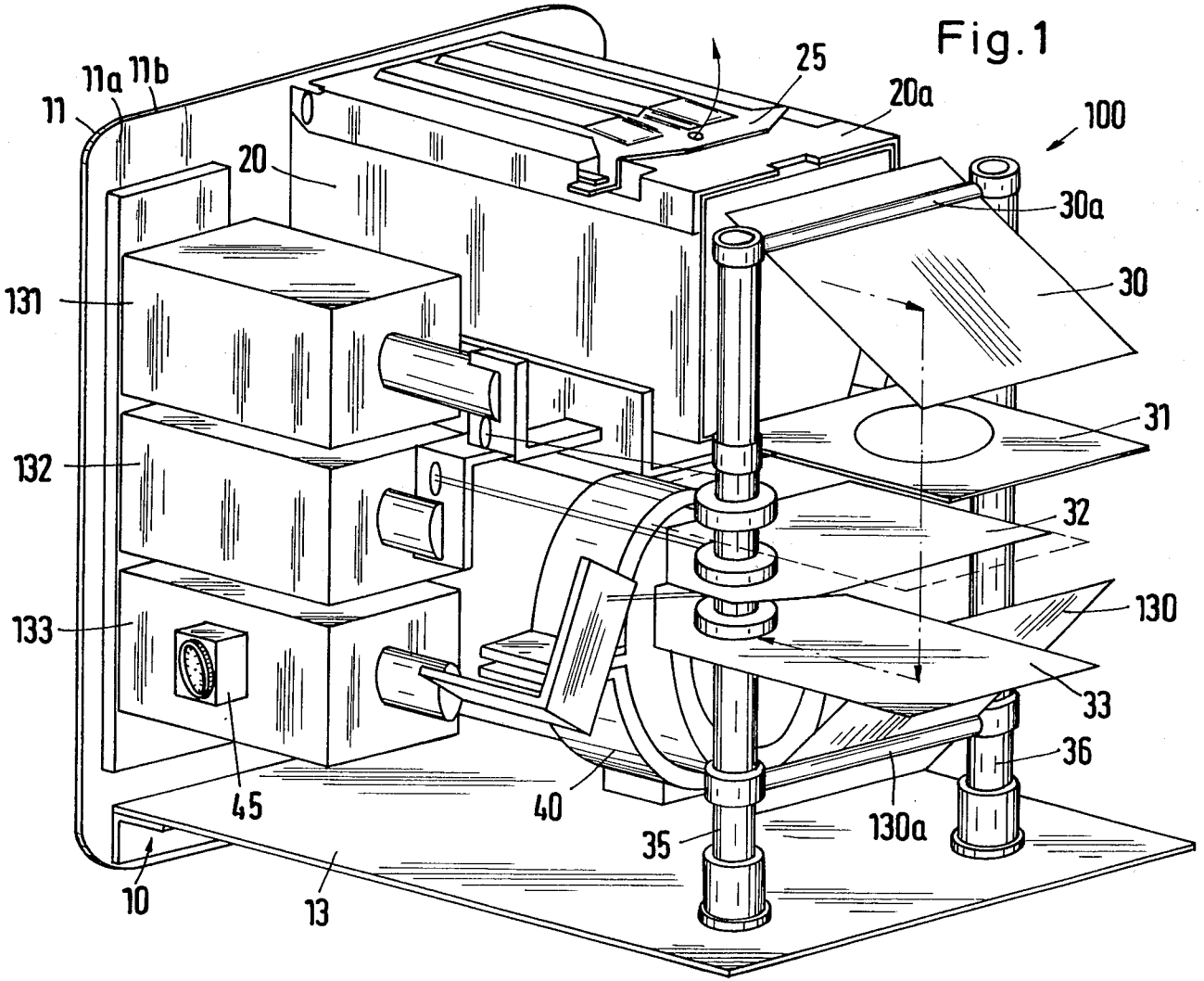
FIG. 1 The apparatus for providing a field of view for carrying out work during darkness on transloading posts in diagrammatic form.
Figure 2:
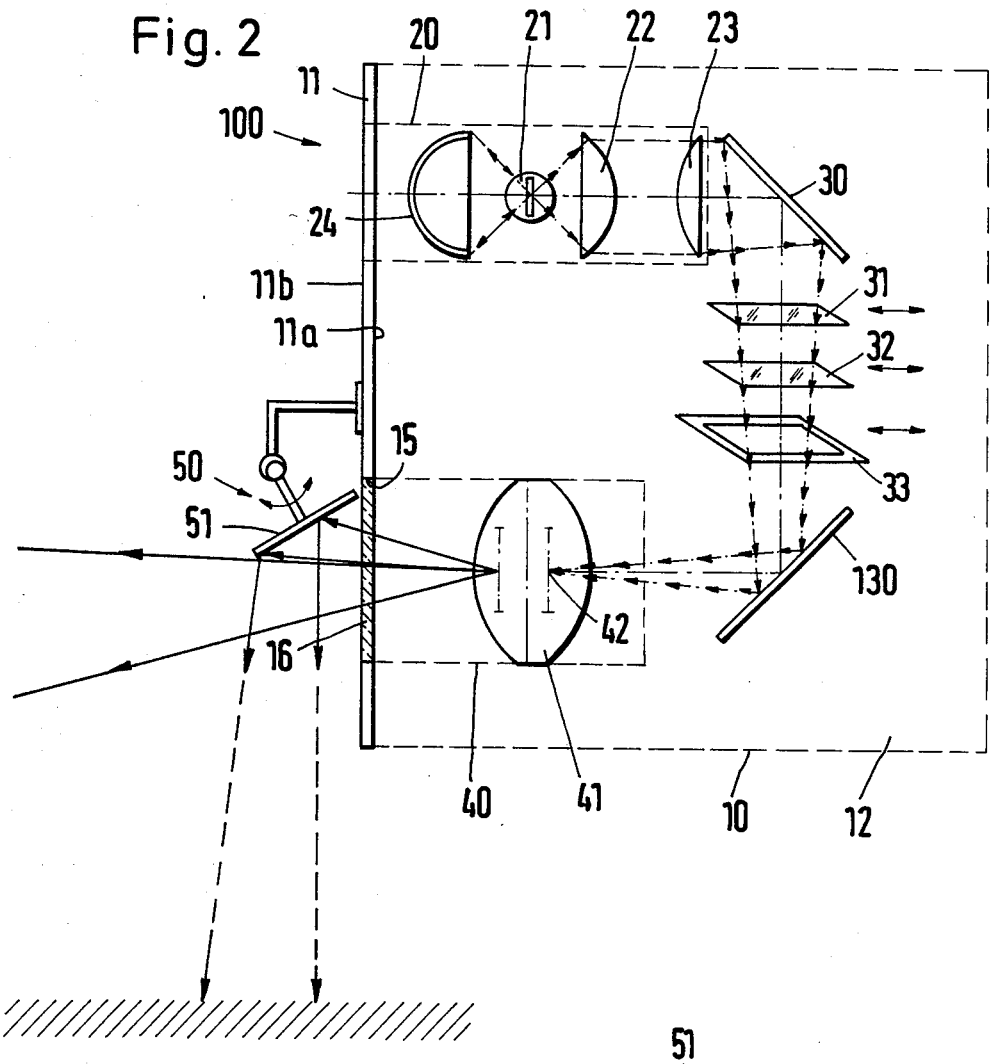
FIG. 2 A diagrammatic view of the construction of the apparatus.

According to FIGS. 1 and 2, apparatus 100, which is particularly intended for transloading or handling vehicles, such as fork lift trucks and the like, serves to provide a field of view for carrying out work during the hours of darkness, particularly on military field transloading posts. It comprises an approximately square or rectangular casing 10 having a front plate 11 and a base plate 13, its further side walls not being shown in FIG. 1.

In the interior 12 of casing 10 is provided a lamp housing 20, which is fixed to the inside 11*a* of front plate 11 in the upper area of the apparatus. This lamp housing has a light source 21, a condenser lens 22 and a front lens 23 located in the optical path. Light source 21 is so arranged with respect to the aspherical or oorrespondindly shaped condenser lens 22, that the light flux irradiated by it is detected as completely as possible. A spherical auxiliary mirror 24 associated with light source 1 can advantageously be used in this connection. Front lens 23 images the light coil filament in the entrance pupil 42 of a subsequently described exit optics 41.

The optical path from light source 21 is deflected twice by 90° by means of two plane mirrors 30, 130, as is visible from FIGS. 1 and 2. The two plane mirrors 30, 130 are superimposed and spaced, each of the two mirrors being fixed to vertical support columns 35, 36, which are connected to the base plate 13 of casing 10. Each plane mirror 30 or 130 is advantageously pivotable about pivot axes 30*a* or 130*a* in order to obtain a precise reciprocal setting of said mirrors 30, 130.

In order to be able to change the light source 21 in lamp housing 20, the upper covering 20*a* of housing 20 is provided with an opening closable by means of a cover plate 25. It is also possible to replace the complete lamp housing 20 with light source 21, condenser lens 22 and front lens 23 by another optical system linked with the light source. For this purpose, the lamp housing 20 is held in not shown guides in the inner area of casing 10 and can be removed by means of an opening provided in front plate 11.

Between the two plane mirrors 30, 130, beam-limiting diaphragms 31, 32 are provided in the optical path, as well as various filters 33, which can be pivoted into and out of the optical path between the two plane mirrors 30, 130 by means of electromotive or electromagnetic drive means 131, 132, 133. The number of diaphragms and filters can be chosen at random and will be a function of the nature of the desired apron iliumination. Advantageously several filters are provided which are constructed as grey filters, as will be mentioned hereinafter.

The filtered or unfiltered light energy constricted by the in each case desired diaphragm passes into the exit optics 41, which are housed in a further case 40, which is also fixed in the lower area of casing 10 to the inside 11*a* of front plate 11. This exit optics images the beam bundle influenced by the diaphragm at infinity, or on the basis of the given requirements through the distance between the exit optics and front lens 23, in a finite, i.e. control distance.

In the optical path of exit optics 41 a light exit port 15 covered by a glass disk 16 is provided in front plate 11. In the vicinity of port 15 on the outside 11*b* of front plate 11 of casing 10 is provided a device 50 with a plane mirror 51 which downwardly deflects that part of the illumination energy leaving the exit optics 41, said plane mirror 51 being pivotable about a horizontal axis.

In order to make the apparatus universal, the possibility has been provided of setting different illumination levels. Since on reducing the lamp supply voltage, there is a spectral red shift in all tungsten continuous radiators, which in turn leads to a displacement of the filter characteristics, attenuation is achieved in the case of apparatus 100 by pivoting in more or less dense, colour-neutral, optically clear grey filters, grey filter 33 being shown in FIGS. 1 and 2. According to one embodiment a specific grey filter is necessarily connected upstream and can only be swung out in time-limited manner in the case of express switching instructions. For this purpose grey filter 33 is connected to an electromotive or electromagnetic drive means 133, by means of which the swinging in and out is controlled. There is also a device, such as a time switch or the like 45, by means of which the time spent by grey filter 33 in the swung out position is fixed, whilst at the end of this time and by means of the controlled drive device 133, the grey filter is swung back into the optical path. This ensure that in normal attenuated operation, apparatus 100 is operated with an illumination energy which is no prejudicial with regards to the undesired observation.

Figure 3:
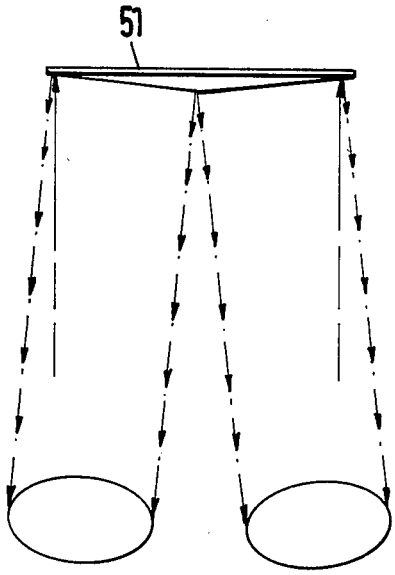
FIG. 3 The outer plane mirror of the apparatus in a special geometrical configuration.

Device 50 with the pivotable plane mirror 51 provided on front plate 11 at th front of the apparatus permits this setting in such a way that part of the illumination energy leaving the exit optics 11 is deflected downwards. This provides the possibility not only of illuminating remote objects, but also the apron or e.g. only the forks of a fork lift truck. The energy adapted to the particular requirements is so dimensioned by the size of the branched partial beam bundle for this partial illumination that in the case of alternate observation of remote and near objects, approximately the same reaction energy affects the operator's eyes. This avoids a readaptation of the eye. A favourable light distribution of the apron illumination adapted to the conditions can be achieved by a corresponding geometrical configuration of the outer plane mirror 51, as is e.g. shown in FIG. 3.

What is claimed is:

1. An apparatus, particularly for transloading vehicles, such as fork lift trucks and the like, for providing a field of view for carrying out work at night, particularly at military field transloading posts, wherein, the apparatus comprises an apparatus casing with a front plate, in whose interior in the upper region of the rear surface of the front plate is provided a lamp housing with a light source, a condenser lens connected upstream thereof and detecting the complete irradiated light flux and a front lens located in the optical path of the light source and to which is connected two plane mirrors which deflect the optical path twice by 90° and which are spaced from and superimposed with respect to on another, whereby between the two plane mirrors in the optical path are arranged diaphragms and/or filters which can be pivoted into and out of the same by means of electromotive or electromagnet drive means or the like and below the lamp housing is provided a further case receiving exit optics for imaging the lamp coil filament in the entrance pupil of the exit optics through the front lens and wherein in the optical path of the exit optics in the front plate is provided a light exit port covered by means of a glass disk.

2. An apparatus according to claim 1, wherein a grey filter which can be pivoted in and out is arranged in the optical path between the two plane mirrors.

3. An apparatus according to claim 1, wherein the grey filter can be pivoted in and out by means of an electromotive or electromagnetic drive means and by means of a device, such as a time switch or the like, it is possible to fix the time during which the grey filter is in the pivoted out position and at the end of this time the grey filter is pivoted back into the optical path by means of the controlled drive means.

4. An apparatus according to claim 1, wherein on the outside of the casing front plate in the vicinity of the light exit port is provided a device with a pivotable outer plane mirror which deflects downwards that part of the illumination energy leaving the exit optics.

* * * * *